US006291537B1

(12) United States Patent
Ciminelli et al.

(10) Patent No.: US 6,291,537 B1
(45) Date of Patent: Sep. 18, 2001

(54) ENCAPSULATION OF OXIDANTS FOR PITCH STABILIZATION

(75) Inventors: David L. Ciminelli, Amherst, NY (US); Partha P. Paul; Niraj Vasishtha, both of San Antonio, TX (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 09/537,818

(22) Filed: Mar. 28, 2000

(51) Int. Cl.[7] ..... C10C 3/04

(52) U.S. Cl. ..... 521/76; 208/44; 208/39; 423/447.4

(58) Field of Search ..... 423/447.4; 521/76; 208/44, 39; 523/179

(56) References Cited

U.S. PATENT DOCUMENTS

| | | | | |
|---|---|---|---|---|
| 4,883,617 | | 11/1989 | Benn et al. . | |
| 4,986,943 | | 1/1991 | Shaeffer et al. . | |
| 5,225,070 | | 7/1993 | Cornec et al. . | |
| 5,316,654 | * | 5/1994 | Berkebile et al. | 208/39 |
| 6,022,641 | * | 2/2000 | Endo et al. | 429/232 |

* cited by examiner

*Primary Examiner*—James J. Seidleck
*Assistant Examiner*—Melanie D. Bagwell
(74) *Attorney, Agent, or Firm*—Charles E. Bricker; Thomas L. Kundert

(57) ABSTRACT

Controlled and thorough stabilization of pitch is provided by incorporating an oxidant into the pitch. In one embodiment of the invention, the oxidant is intimately mixed with the pitch. In another embodiment, the oxidant is encapsulated in a suitable encapsulant and the encapsulated oxidant is intimately mixed with the pitch. This material is particularly useful in the preparation of a carbon-carbon composite, but is also useful for preparing fibers and solid preforms.

6 Claims, No Drawings

ENCAPSULATION OF OXIDANTS FOR PITCH STABILIZATION

RIGHTS OF THE GOVERNMENT

The invention described herein may be manufactured and used by or for the Government of the United States for all governmental purposes without the payment of any royalty.

BACKGROUND OF THE INVENTION

The present invention relates to pitches, particularly mesophase pitches.

Although carbon-carbon composites now find a variety of applications, ranging, for example, from prosthetic implants to components for braking systems and heat exchangers, the major impetus for their further development continues to come from space and defense needs, where the high costs and lengthy processing times of conventional fabrication methods can be justified by unique capabilities of thermal and mechanical performance in the final composite product.

Two types of carbon-carbon composites are widely used: 3D composites that are essentially carbon bodies with some carbon fiber reinforcement effective in all directions, and 2D composites that are usually comprised of one or more parallel plies of fabric woven from carbon fiber. The 3D composites usually take the form of compact bodies that can be used to make nose cones or rocket nozzles for space vehicles. The 2D composites usually take the form of thin-walled tubes, plates, or other shell-like shapes that are particularly useful for structures where lightness, stiffness, and strength are primary considerations.

Three general methods are used in the current art of fabricating carbon-carbon composites. The carbon matrix may be deposited within a carbon fiber preform by: (1) chemical vapor infiltration (CVI) from hydrocarbon gases, such as methane or natural gas; (2) liquid impregnation with thermosetting resins that harden before carbonization reactions begin; or (3) impregnation with liquid pitches including synthetic pitches, as well as those derived from petroleum or coal tar. Repetitive cycles of impregnation and carbonization are usually required to attain useful density levels. In fabrication practice, the method of impregnation may be varied from cycle to cycle.

As presently practiced, all processes are slow and expensive, and fail to realize fully the strength of the reinforcing fibers. Thus a situation has come to exist in which carbon-carbon composites find use in critical applications where no other material could serve, but serious constraints of cost, processing time, and reliability in fabrication limit their development for other applications where such properties as stiffness or refractoriness could provide substantial advantages over other structural materials.

In applying the process of chemical vapor infiltration, it is essential that an appreciable fraction of the reactive gas species diffuse into the full depth of the porous body before carbonization. To maintain such "throwing power," the process must be restricted to pressure and temperature conditions that make the CVI process inherently slow, expensive, and suitable primarily for thin-walled 2D composites. In practice, "bottleneck" pores limit the attainable density levels, and the formation of external crusts of pyrolytic carbon requires the process to be interrupted for cleaning between cycles. Nevertheless CVI processing is a significant competitor in the prior art of carbon/carbon fabrication and may find an important role in combination with liquid impregnation processes as a final infiltration step to control the degree of fiber-matrix bonding.

Thermosetting resins have been well-exploited for carbon-carbon fabrication because an extensive technology base (in fiber-reinforced plastics) exists for these matrices that can be fixed in place prior to carbonization. However, this thermosetting characteristic also leads to the formation of glassy carbons that are inherently brittle, low in density, and difficult to graphitize. The commonly used impregnants are phenolic resins that carbonize with only modest yield; although higher-yield resins are being explored, they tend to be costly and lack a technology base. The linear shrinkage in carbonization is typically about 20% and can cause severe fiber damage if benign patterns of shrinkage fracture do not form in the matrix. These difficulties require lengthy steps of curing and carbonization and a number of repetitive cycles to reach density levels of 1.65 g/ml.

Pitch-based processing methods emerged from the technology base established by the manufacture of artificial graphites. These processes seek to realize the advantages of high carbon yield and excellent graphitizability that are characteristic of pitch. Pitches are comprised primarily of polynuclear aromatic molecules. Upon pyrolysis, reactions of aromatic polymerization carry the pitch through a liquid crystalline state, known as the carbonaceous mesophase, in which graphitizability is established by parallel alignment of the large flat aromatic molecules. Graphitizable precursors produce cokes of higher density, and graphitic matrices are less brittle than glassy carbon matrices.

These advantages have led to a substantial carbon-carbon fabrication technology based on pitch impregnants. However, the carbonaceous mesophase is a viscous reactive liquid in the practical ranges of processing variables, and the gaseous reaction products cause bloating effects that can seriously reduce densification efficiency. That mesophase pitches bloat seriously upon carbonization, even under substantial applied pressures, is known from studies of petroleum coking in which foaming has been found to commence when the coke feedstock transforms to bulk mesophase, and the microstructure of the coke has been shown to depend on the amount of deformation by bubble percolation. Experience with pitch-based composite processing shows that it is difficult to achieve composite densities greater than 1.6 g/ml as long as room-pressure carbonization methods are used. Thus, although the mechanisms defeating the attainment of high composite densities are different than in the case of processing with thermosetting resins, the ultimate practical density levels are comparable for the two conventional approaches to room-pressure densification by liquid impregnation.

One prior art solution to the difficulties of densification with pitch impregnants is to use an autoclave to apply high pressure during the pyrolysis process until the matrix hardens to coke. This approach is attractive not only to reduce the volume of bubble porosity within the matrix, but also because high-pressure pyrolysis offers a potential increase in carbon yield. In practice the autoclave systems are run at pressures on the order of 15 kpsi to temperatures of about 600° C. This necessarily involves a substantial capital investment in autoclaves, control equipment, and safety facilities. Furthermore high-pressure processing is limited by practical autoclave sizes.

However, detailed analyses of the efficiency of carbon pickup within 3D preforms for each cycle of impregnation and carbonization reveal that the gains in densification by pressure pyrolysis are less than might have been expected. The difficulty in improving the efficiency appears to lie in the fact that the gases emitted during the final stages of mesophase formation and hardening are principally methane and hydrogen, both of which are non-condensable under the pyrolysis conditions. Although pressure applied during pyrolysis reduces the volume of gas evolved in the critical range of mesophase hardening, the volume is still sufficient to expel appreciable amounts of matrix from the fiber preform, and thus to reduce the cycle efficiency.

In fact some bubble porosity seems to be inevitable in any pitch-based process as long as thermal methods are used to harden the mesophase matrix, because the non-condensable gases are essential products of the polymerization reactions that effect the hardening. In this sense high-pressure pyrolysis is an incomplete and less than satisfactory solution to the problem of attaining efficiency in pitch-based densification.

Mesophase pitch is also widely used in the fabrication of carbon fiber and solid carbon articles. Oxidation stabilization is a key step in the manufacture of carbon fiber spun from mesophase pitch. To maintain the strong preferred orientation established by the extensive flow during spinning, and to prevent softening and bubble formation within the filaments during heat treatment, the green fiber is oxidized before carbonization. The oxidizing temperature is generally held below 300° C. to avoid structural changes in the oriented mesophase while oxidation is in progress. The stabilization process is limited by solid-state diffusion to filament diameters of the order of 15 microns, because mesophase filaments generally do not possess a structural porosity giving gaseous access to the interior of the filament.

In application to solid carbon articles, oxidation stabilization is particularly useful for mesophase pitch articles, in which bloating tendencies are very strong. The oxidation does not affect the improved graphitization, which is determined by the extent of mesophase transformation established before the oxidation. The solid carbon articles are formed by compacting pitch particles in the shape that is required.

It has been proposed that densification efficiency in the pitch-based processing of carbon-carbon composites can be enhanced by applying an oxidation treatment to stabilize the matrix in place within the fiber preform prior to the carbonization step. The increased efficiency results from two independent physical and chemical effects obtained by oxidative cross-linking of the aromatic molecular constituents of the pitch-based matrix: (1) physical melting, bloating, and expulsion of the matrix from the preform are prevented during carbonization, and (2) less carbon is lost from the matrix material in the chemical reactions of carbonization, i.e., the carbon yield of the matrix material is increased.

The starting materials for the oxidation stabilization process may be 1D, 2D or 3D carbon fiber preforms that have been impregnated with a pitch or mesophase pitch derived from petroleum, coal tar, or any similar tar-bearing source by chemical, extractive, or thermal treatments. Impregnation may be accomplished by any process that causes the pitch or mesophase pitch to enter the interstices of the 1D, 2D or 3D preform, including dipping, wicking, pre-impregnation, pressure cycling, or mechanical injection.

The formation of a connected porosity in the matrix to provide access for oxygen gas to all regions of the composite is essential to success in the stabilization process. In a carbon fiber preform impregnated with a pitch of high softening point, an adequate access porosity often forms by simple cooling to room temperature. This porosity is due to shrinkage cracking caused by the mismatch in thermal expansivities of fiber and matrix operating over the temperature region from the softening point of the pitch to the cooling temperature. Partial closure of the cracks will occur on heating to the oxidation temperature. Thus higher softening points and lower oxidation temperatures are favorable to adequate access porosity and successful stabilization. In the case of mesophase pitch impregnants, the effect of differences in thermal expansivities between matrix and fiber is enhanced by the anisotropy in expansivity of the bulk mesophase itself; this anisotropy is sufficiently strong to develop an extensive system of shrinkage cracks in the absence of carbon fibers.

The impregnated and cooled composite preform is placed in a conventional furnace and heated to the oxidation temperature in a stream of oxidizing gas. Temperatures may vary generally between 190° and 300° C., such that the temperature remains below the softening point of any microconstituent of the impregnant. The matrix then absorbs oxygen through the microcrack network and polymerizes to an infusible solid. However, the depth of oxygen penetration into the pitch is generally limited to about 50 $\mu$m, thus limiting the use of pitch infiltration to relatively thin composites.

Oxidation of the pitch prior to infiltration is not a viable option because oxidized pitch is even more viscous than non-oxidized pitch. As discussed above, oxidation following infiltration is limited by access porosity and depth of oxygen penetration. What is desired is a pitch material which will flow like unoxidized pitch, thus allowing good infiltration into a matrix, and which is self-oxidizing, thus allowing complete oxidation of the pitch.

Accordingly, it is an object of the present invention to provide a self-stabilizing pitch material.

Other objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

SUMMARY OF THE INVENTION

In accordance with the present invention there is provided a pitch material consisting essentially of about 1 to 60 weight percent of an oxidant, balance pitch. In one embodiment of the invention, the oxidant is intimately mixed with the pitch. In another embodiment, the oxidant is encapsulated in a suitable encapsulant and the encapsulated oxidant is intimately mixed with the pitch. This material is particularly useful in the preparation of a carbon-carbon composite, but is also useful for preparing fibers and solid preforms. Incorporation of an oxidant into the pitch allows for controlled and thorough stabilization of the pitch.

DETAILED DESCRIPTION OF THE INVENTION

The pitch material can be any pitch, including pitches derived from steam cracking residues, thermal or catalytic cracking residues, asphalt pitches, pitches from distillation residues of petroleum residues, coal tar pitches, extract pitches and mixtures thereof, as well as synthetic pitches, such as those produced by polymerizing a condensed polycyclic aromatic hydrocarbon. The pitches used are desirably pitches possessing high softening points and containing little volatile product. They are preferably, pitches having a Kraemer-Sarnow (KS) softening point between 90° and 250° C. Examples of suitable pitch are: HS pitch (anisotropic, heat soak natural pitch); Ashland 240 pitch (isotropic, available from the Ashland Chemical Company);

A80 AEROCARB pitch (isotropic, available from Ashland Chemical Company); and Mitsubishi AR pitch (chemically prepared, mesophase, anisotropic, available from Mitsubishi Gas Chemical Company).

Preferred pitches are the synthetic pitches, such as those prepared by the process described in Mochida et al, U.S. Pat. No. 4,891,126, issued January 2, 1990. This patent discloses a mesophase pitch obtained from polymerizing a condensed polycyclic aromatic hydrocarbon, such as naphthalene, in the presence of a hydrogen fluoride/boron trifluoride catalyst, which pitch contains at least about 90% of an optically anisotropic phase. An exemplary pitch is AR Resin® manufactured by Mitsubishi Gas Chemical Co., Tokyo, Japan. This pitch is produced by the catalytic polymerization of naphthalene and is supplied in pellet form. The pitch has a softening temperature of 239° C., is 100% anisotropic, and has a glass transition temperature range of 230° to 260° C.

The oxidant can be any solid material which releases oxygen when decomposed. Suitable oxidants include $NH_4NO_3$, $NaNO_3$, $KNO_3$, Pb(NO3)2, $KClO_4$, $NH_4ClO_4$, $KClO_3$, $KMnO_4$, sodium percarbonate, sodium benzoate, calcium peroxide and manganese dioxide.

In a presently preferred embodiment, the oxidant is encapsulated in a suitable encapsulant and the encapsulated oxidant is intimately mixed with the pitch. Examples of suitable encapsulants include polyetherimide, polyphenylene ether, poly(imidothioether), polyvinylidiene chloride/flouride, poly(hydroxy benzoate), polydithiopyromelletimidine, polyoxamides-polydiphenylamine copolymers, polyphenylenesulfide, polyimic acid-imide copolymer, polyhydroxy benzoate and the like. Microcapsules containing oxidant may be prepared by several conventional encapsulation techniques such as spray drying, rotating disk, stationary extrusion, centrifugal extrusion, air suspension, pan coating and the like.

The oxidant, unencapsulated or encapsulated, is mixed with the pitch in an amount ranging from 5 to 50 percent, by weight. Prior to mixing, the pitch is preferably milled to a small particle size.

The oxidant/pitch mixture of this invention is used in much the same manner as pitch is now used, with the exception that a separate stabilizing step is not required. A pitch mixture containing unencapsulated oxidant is heated to a temperature sufficient to decompose the oxidant, at which temperature stabilization of the pitch begins. A pitch mixture containing encapsulated oxidant is heated to a temperature sufficient to melt and/or decompose the encapsulating material, thus releasing the oxidant. If this temperature is at or above the temperature of decomposition of the oxidant, stabilization of the pitch begins, otherwise, a further increase in temperature may be required. Encapsulation of the oxidant thus provides closer control of stabilization by the choices of encapsulant, with its known or easily determined melt- or decomposition-temperature, and oxidant, with its known or easily determined decomposition-temperature. Using conventional processing techniques, the pitch, once incorporated into a matrix or extruded into a fiber, must be separately stabilized. The oxidant/pitch mixture of this invention allows for greater flexibility in processing. For example, in the fabrication of a carbon-carbon composite, the oxidant/pitch mixture is heated to an elevated temperature sufficient to flow the mixture into the interstices of the matrix. A further increase in temperature causes the oxidant to stabilize the pitch. A yet further increase in temperature causes the thus-stabilized pitch to carbonize. In general, a temperature of about 300° to 450° C. is sufficient to decompose the oxidant and to melt or decompose the encapsulant, if the latter is used. In the fabrication of carbon fibers, the oxidant/pitch mixture is heated to an elevated temperature sufficient to allow forcing the resulting molten mixture under pressure through an orifice to obtain green fibers. The green fibers are stabilized by a further increase in temperature. In contrast to conventional processing techniques which stabilize from the surface of the fiber inward, the whole of the fiber is stabilized because the oxidant is dispersed throughout. The fiber is then carbonized by conventional techniques.

As noted previously, bloating is a problem, particularly with mesophase pitches. Although the oxidant/pitch mixture of this invention exhibits this problem, bloating can be reduced by heating the article comprising this mixture to a temperature of about 300° to 450° C., holding the thus-heated article at this temperature for about 15 to 90 minutes, and then continuing to increase the temperature until the carbonization temperature is achieved.

The following examples illustrate the invention:

EXAMPLE

Ammonium nitrate/Ultem™ polyetherimide (available from General Electric Company) was employed as the encapsulant system. This system contained particles ranging from 125–250 μm. The ammonium nitrate consisted of crushed particles with a size from 5–20 μm and comprised 40% by weight of the encapsulated system. The encapsulated oxidant was mixed with jet milled Mitsubishi AR mesophase pitch in the amounts shown in Table I, below. The pitch particles had an average diameter of 1.5 μtm. Some samples were also mixed with Pyrograf-III® vapor-grown carbon fiber, available from Applied Sciences, Inc., Cedarville, Ohio. All contents are by weight percent.

All samples were approximately 2.0 grams and were dry mixed in a Spex Mill/Mixer model 8000 for 30 seconds to evenly disperse the constituents. Samples were then pressed into 2.3 cm diameter discs approximately 3 mm thick using 211 MPa (30.5 ksi). Although not melt processed, under this pressure the pitch consolidates into a solid. Certain samples, as noted, were heat treated in an air oven to the temperature noted at 2–5° C./min and allowed to soak for one hour. The preheat step allowed the encapsulant and oxidant time to decompose and stabilize the pitch prior to the onset of carbonization. All samples were carbonized at 1° C./min to 900° C. and held for 4 hours. After carbonization the volume expansion was observed as the measure of bloating. Table I details the composition of the various samples:

TABLE I

Encapsulated Oxidant/Pitch Formulations

| Sample | Pitch % | Encapsulated Oxidant % | Fiber % | Preheat | Volume Expansion |
|---|---|---|---|---|---|
| E0 | 100 | 0 | — | — | 84 |
| E10 | 90 | 10 | — | — | 45 |
| E20 | 80 | 20 | — | — | 36 |
| E25A | 75 | 25 | — | — | 27 |
| E25B | 56 | 19 | 25 | — | 3.8 |
| E30 | 70 | 30 | — | — | 17 |
| E40A | 60 | 40 | — | — | 4.6 |
| E40B | 60 | 40 | — | 350° C. | 2.8 |
| E50A | 50 | 50 | — | — | 2.3 |
| E50B | 50 | 50 | — | 350° C. | 1.1 |
| E50C1 | 40 | 40 | 20 | — | 3.7 |
| E50C2 | 40 | 40 | 20 | 350° C. | 1.2 |

Samples were also studied without the use of the encapsulant coating. In these samples, designated ENC (encapsulant no coating), pure ammonium nitrate was dispersed in the pitch. Formulations and results are shown in Table II:

TABLE II

Non-encapsulated Oxidant/Pitch Formulations

| Sample | Pitch % | Oxidant % | Fiber % | Preheat | Volume Expansion |
|---|---|---|---|---|---|
| ENC10A | 90 | 10 | — | — | 56 |
| ENC10B | 90 | 10 | — | 350° C. | 45 |
| ENC20A | 80 | 20 | — | — | 43 |
| ENC20B | 80 | 20 | — | 350° C. | 7.6 |
| ENC20C | 80 | 20 | — | 325° C. | 19 |
| ENC30A | 70 | 30 | — | 350° C. | 4.5 |
| ENC30B | 70 | 30 | — | — | 1.7 |

The initial volume of all samples was approximately 1.25 cc. The final volume, after carbonization, is given in Tables I and II as Volume Expansion, relative to the initial sample size. This value is the factor by which the carbonized sample is greater than the original volume.

The data above clearly show that all of the samples containing the encapsulant/oxidant system experienced a reduction in bloating. Also, this reduced bloating effect was enhanced with higher concentrations of the encapsulant/oxidant. Simply adding the encapsulant/oxidant and processing the system yielded a volume expansion of 2.3 times the original volume at a 50% encapsulant loading. Preheat-treating the samples before carbonization further reduced the bloating of the samples. The 50% encapsulant/oxidant-loaded and heat-treated sample showed only minor, 10%, volume expansion. The preheat treatment has a great effect on the sample. The three uncoated samples at 20 percent loading indicates that the preheat temperature also has a large effect on expansion. While both the preheat treated samples expanded less than the directly carbonized sample, the 350° C. sample experienced only one-third the expansion of the 325° C. treated sample.

Having thus described exemplary embodiments of the present invention, it should be noted by those skilled in the art that the disclosures herein are exemplary only and that alternatives, adaptations and modifications may be made within the scope of the present invention.

We claim:

1. A pitch material consisting essentially of about 1 to 60 weight percent of an encapsulated oxidant and 99 to 40 weight percent pitch.

2. The pitch material of claim 1 wherein said oxidant is encapsulated in an encapsulant selected from the group consisting of polyetherimide, polyphenylene ether, poly (imidothioether), polyvinylidiene chloride/flouride, poly (hydroxy benzoate), polydithiopyromelletimidine, polyoxamides-polydiphenylamine copolymers, polyphenylenesulfide, polyimic acid-imide copolymer and polyhydroxy benzoate.

3. The pitch material of claim 1 wherein said pitch is a mesophase pitch.

4. The pitch material of claim 1 wherein said oxidant is selected from the group consisting of $NH_4NO_3$, $NaNO_3$, $KNO_3$, $Pb(NO_3)_2$, $KClO_4$, $NH_4ClO_4$, $KClO_3$, $KMnO_4$, sodium percarbonate, sodium benzoate, calcium peroxide and manganese dioxide.

5. The pitch material of claim 1 wherein said pitch is a mesophase pitch and wherein said oxidant is ammonium nitrate.

6. The pitch material of claim 5 wherein said oxidant is encapsulated in polyetherimide.

* * * * *